US007128025B1

(12) United States Patent
Westhoff, Jr. et al.

(10) Patent No.: US 7,128,025 B1
(45) Date of Patent: Oct. 31, 2006

(54) DUAL TEMPERATURE CLOSED LOOP COOLING SYSTEM

(75) Inventors: Paul E. Westhoff, Jr., Kenosha, WI (US); Michael Dopona, Wartberg (AT)

(73) Assignees: BRP US Inc., Sturtevant, WI (US); BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 10/971,558

(22) Filed: Oct. 25, 2004

Related U.S. Application Data

(60) Provisional application No. 60/514,208, filed on Oct. 24, 2003.

(51) Int. Cl.
*F01P 9/00* (2006.01)

(52) U.S. Cl. ..... 123/41.01

(58) Field of Classification Search ..... 123/41.01, 123/41.31, 41.08, 41.82 R, 195 P; 440/88 R, 440/89 R See application file for complete search history.

(56) References Cited

U.S. PATENT DOCUMENTS

| | | | | |
|---|---|---|---|---|
| 468,050 | A | 2/1892 | Trabold | |
| 2,382,218 | A | 8/1945 | Fernstrum | |
| 3,240,179 | A | 3/1966 | Ranst | |
| 3,292,373 | A | 12/1966 | Tado | |
| 3,650,310 | A | 3/1972 | Childress | |
| 3,841,396 | A | 10/1974 | Knaebel et al. | |
| 4,557,319 | A | 12/1985 | Arnold | |
| 4,747,450 | A | 5/1988 | Ikegame et al. | |
| 5,383,803 | A | 1/1995 | Pilgrim | |
| 5,408,965 | A | 4/1995 | Fulton et al. | |
| 5,507,673 | A | 4/1996 | Boggia | |
| 5,732,665 | A | 3/1998 | Morrison | |
| 5,846,102 | A | 12/1998 | Nitta et al. | |
| 5,921,829 | A * | 7/1999 | Iwata | 440/88 R |
| 6,015,320 | A | 1/2000 | Nanami | |
| 6,544,085 | B1 | 4/2003 | Ménard et al. | |
| 6,604,494 | B1 * | 8/2003 | Skrzypchak et al. | 123/41.31 |

OTHER PUBLICATIONS

Bombardier Inc., Ski-Doo 1997 Parts Catalog, Formula III / Formular III LT, Sep. 1996, 4 pages.

R.W. Fernstrum & Company, Inc., Fernstrum Gridcooler Installation and Maintenance Form 160, pp. 1-12, 2003, http://www.fernstrum.com/pdf_folder/form160.pdf.

* cited by examiner

*Primary Examiner*—Stephen K. Cronin
*Assistant Examiner*—Hyder Ali
(74) *Attorney, Agent, or Firm*—Osler, Hoskin & Harcourt LLP

(57) ABSTRACT

A cooling system and method of cooling an engine are disclosed. The cooling system includes a first closed loop that circulates coolant at a first temperature and a second closed loop that circulates coolant at a second temperature that is different than the first temperature. Such a construction provides two separate cooling temperature circuits for cooling equipment at different cooling temperatures.

16 Claims, 5 Drawing Sheets

DUAL TEMPERATURE CLOSED LOOP COOLING SYSTEM

The present application claims priority to U.S. Provisional Application Ser. No. 60/514,208 dated Oct. 24, 2003, the entirety of which is hereby incorporated into the present application by reference.

BACKGROUND OF THE INVENTION

The present invention relates generally to engine cooling systems and, more particularly, to a closed loop cooling system having multiple cooling loops, each having a different operating temperature.

In general, during fuel combustion in an internal combustion engine, a considerable amount of heat is generated. While the engine is designed to operate at relatively high temperatures, operating at excessive temperatures for extended periods of time is detrimental to engine efficiency and, if unaddressed, can shorten the operating life of an engine. Additionally, operating at temperatures below a desired operating temperature can have just as adverse consequences. For example, operating at too low a temperature can increase soot and condensation buildup in the engine, increase emissions, and reduce fuel efficiency. Therefore, a cooling system is provided to circulate coolant around the cylinders of the engine to provide cooling and maintain a desired operating temperature.

In outboard motors, the engine cooling fluid is often drawn from the body of water the watercraft is operated in. These types of cooling systems, that use the body of water as a reservoir, are often referred to as open loop cooling systems. That is, the coolant flow is not recirculated through the cooling system but continually draws in fresh water and discharges heated water. While this construction serves many needs satisfactorily and allows for a relatively simple construction of the cooling system, such cooling systems do have drawbacks.

One drawback to the open loop cooling system is that the quality of the coolant circulated through the internal passageways of the engine is variable. While a screen can be placed over the inlet to such a system, water born particulates can still be carried to the internal passages of the engine where the particulates can become lodged and obstruct coolant flow therethrough. Such obstruction hinders cooling of the engine in the vicinity of the blockage and can result in localized "hot-spots" during engine operation. These hot-spots are detrimental to engine performance and can result in premature engine failure if left unaddressed. Decreasing the screen openings to further limit the ingress of contaminates only promotes screen blockage and hinders adequate coolant passage.

Additionally, in watercraft operated in saltwater environments, circulating saltwater in the internal passages of the engine has its own drawbacks. Over time, salt can accumulate within the engine passages and insulate the coolant from the engine thereby hindering effective heat transfer.

Engines operated in saltwater environments with open loop cooling systems experience another adverse effect associated with the saltwater cooling flow therethrough. The flow of saltwater through the internal passages of the engine can also lead to galvanic corrosion in interior cooling passages of the engine as the saltwater flows across components manufactured from unlike materials. During galvanic corrosion, an electrolytic reaction occurs between two components manufactured from unlike materials. The saltwater acts as an electrolyte in the galvanic reaction and facilitates the corrosion of an otherwise stable component. To prevent this, manufacturers typically must include a sacrificial anode or implement other expensive manufacturing techniques.

Another drawback to open loop cooling systems in outboard motors is that the engine cannot be operated outside of a body of water. As such, servicing an engine constructed to be cooled with an open loop cooling system requires a water reservoir during operation of the engine in order to provide adequate cooling thereto. As such, having the lower portion of the outboard motor disposed in a tank of water restricts access to those systems of the motor disposed below a waterline, restricts serviceability to specific locations, and increases service time.

Furthermore, the internal combustion engine is not the only component that requires cooling during operation. Auxiliary components such as an electronic control unit (ECU), a fuel vapor separator, and an electronic regulator/rectifier also benefit from being cooled. The cooling paths to these components are even more susceptible to the detriments of open loop cooling discussed above because of smaller diameter of the coolant loop passages. While these components generate enough heat to require some cooling, they generally operate at temperatures that are lower than the preferred operating temperature of the internal combustion engine. In other words, because the internal combustion engine operates at a temperature that is higher than the operating temperature of the auxiliary components, it would be preferable to cool the auxiliary components by a system that operates at a temperature that is lower than the temperature of the system that cools the internal combustion engine.

It would therefore be desirable to provide a closed loop cooling system operable at different temperatures for different components.

BRIEF DESCRIPTION OF THE INVENTION

The present invention provides a closed loop cooling system and method of cooling in which multiple closed loops circulate coolant at temperatures desirable for the particular component to be cooled. Such a construction provides a first operating temperature for an internal combustion engine and a second operating temperature for auxiliary systems.

In accordance with one aspect of the present invention, an outboard motor adapted to be operated in a body of water is disclosed. The outboard motor has a powerhead, an engine housed in the powerhead, the engine having a vertical crankshaft, a mid-section supporting the engine, a lower unit coupled to the mid-section, and a propeller shaft housed in the lower unit and operatively coupled to the engine via the vertical crankshaft. A cooling system is adapted for cooling the outboard motor. The cooling system has at least one cooling loop providing a fluid path, and at least one heat exchanger in thermal communication with the at least one cooling loop. The cooling system is fluidly separate from the body of water.

In accordance with another aspect of the present invention, an outboard motor is disclosed. The outboard motor has a powerhead, an engine housed in the powerhead, the engine having a vertical crankshaft, a fluid-cooled auxiliary component, a mid-section supporting the engine, a lower unit coupled to the mid-section, and a propeller shaft housed in the lower unit and operatively coupled to the engine via the vertical crankshaft. A first closed cooling loop is adapted to cool at least a portion of the engine. A first heat exchanger is in thermal communication with the first closed cooling loop. A second closed cooling loop is adapted to cool the auxiliary component. A second heat exchanger is in thermal communication with the second closed cooling loop.

In accordance with a further aspect of the present invention, a method of cooling components of an outboard motor is disclosed. The method consists in providing an engine having a vertical crankshaft, a fluid-cooled auxiliary component, and a cooling system having a first closed cooling loop and a second closed cooling loop. It also consists in cooling at least a portion of the engine with the first closed cooling loop, and the auxiliary component with the second closed cooling loop. There are also the steps of providing a first heat exchanger, thermally communicating the first heat exchanger with the first closed cooling loop, providing a second heat exchanger, and thermally communicating the second heat exchanger with the second closed cooling loop. It further consists in providing a first thermostat fluidly communicating with the first closed cooling loop, and regulating the flow of coolant from the first closed cooling loop to the first heat exchanger using the first thermostat.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
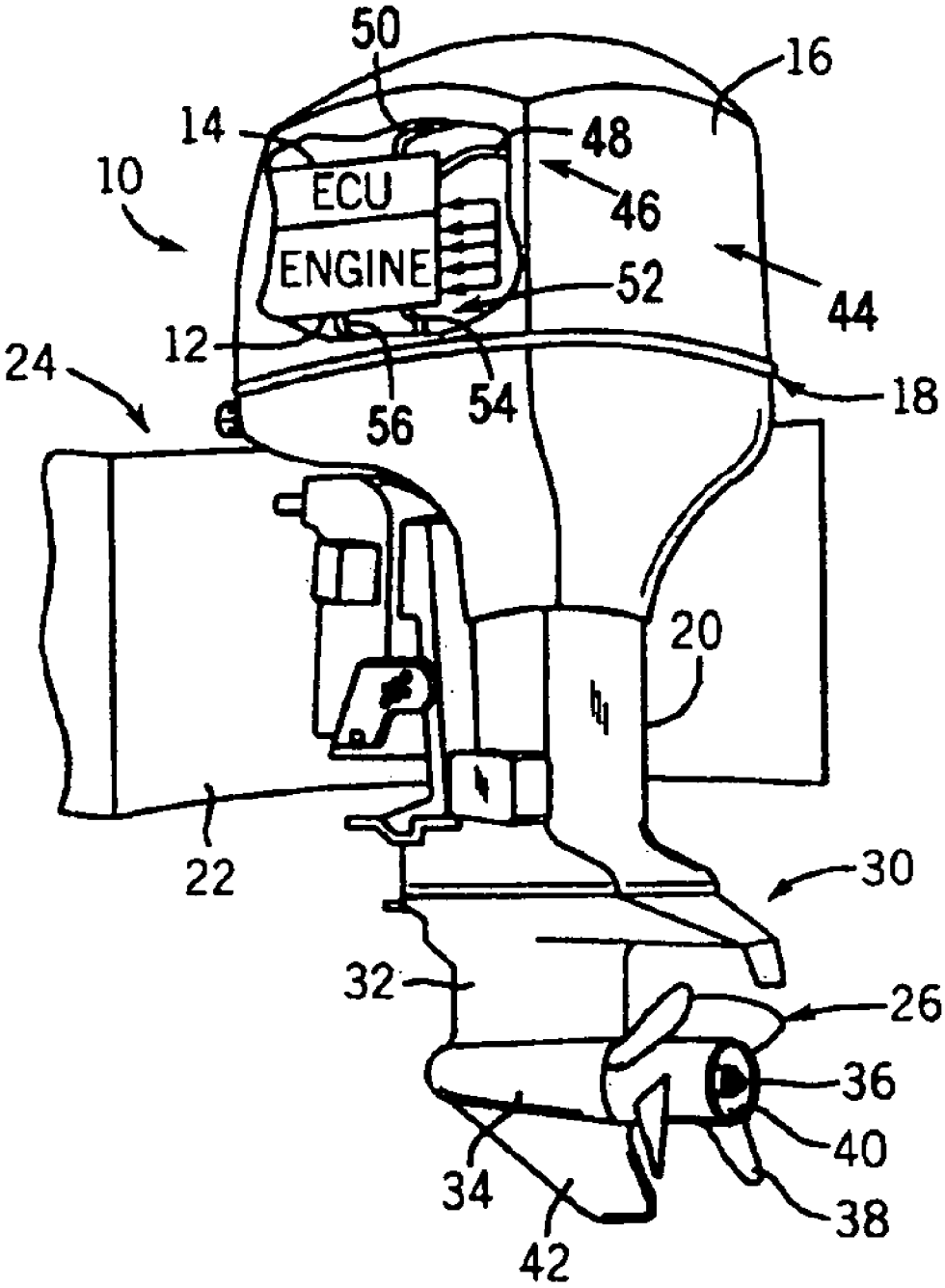
FIG. 1 is a perspective view of an exemplary outboard motor incorporating the present invention.

The present invention relates generally to internal combustion engines, and preferably, those incorporating auxiliary equipment that may benefit from cooling at a temperature different than that of the engine. FIG. 1 shows an outboard motor 10 having an engine 12 controlled by an electronic control unit (ECU) 14 under engine cover 16. Engine 12 is housed generally in a powerhead 18 and is supported on a mid-section 20 configured for mounting on a transom 22 of a boat 24 in a known conventional manner. Engine 12 has a vertical crankshaft (not shown) and is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 extends vertically downwardly from torpedo section 34 to protect propeller fins 38 and encourage the efficient flow of outboard motor 10 through water. For purposes of this invention, engine 12 may be either a two-cycle or a four-cycle engine.

Engine 12 has a cooling system 44 that includes a first cooling loop 46 that provides a fluid path 48 into ECU 14 and a fluid path 50 out of ECU 14. A second cooling loop 52 has a coolant inlet 54 into engine 12 and a coolant outlet 56 from engine 12. In a preferred embodiment, first cooling loop 46 circulates coolant at a temperature that is lower than the temperature of coolant circulated in second cooling loop 52. As such, engine 12 can be operated at a temperature that is higher than that of a preferred temperature of operation of ECU 14.

Figure 2:
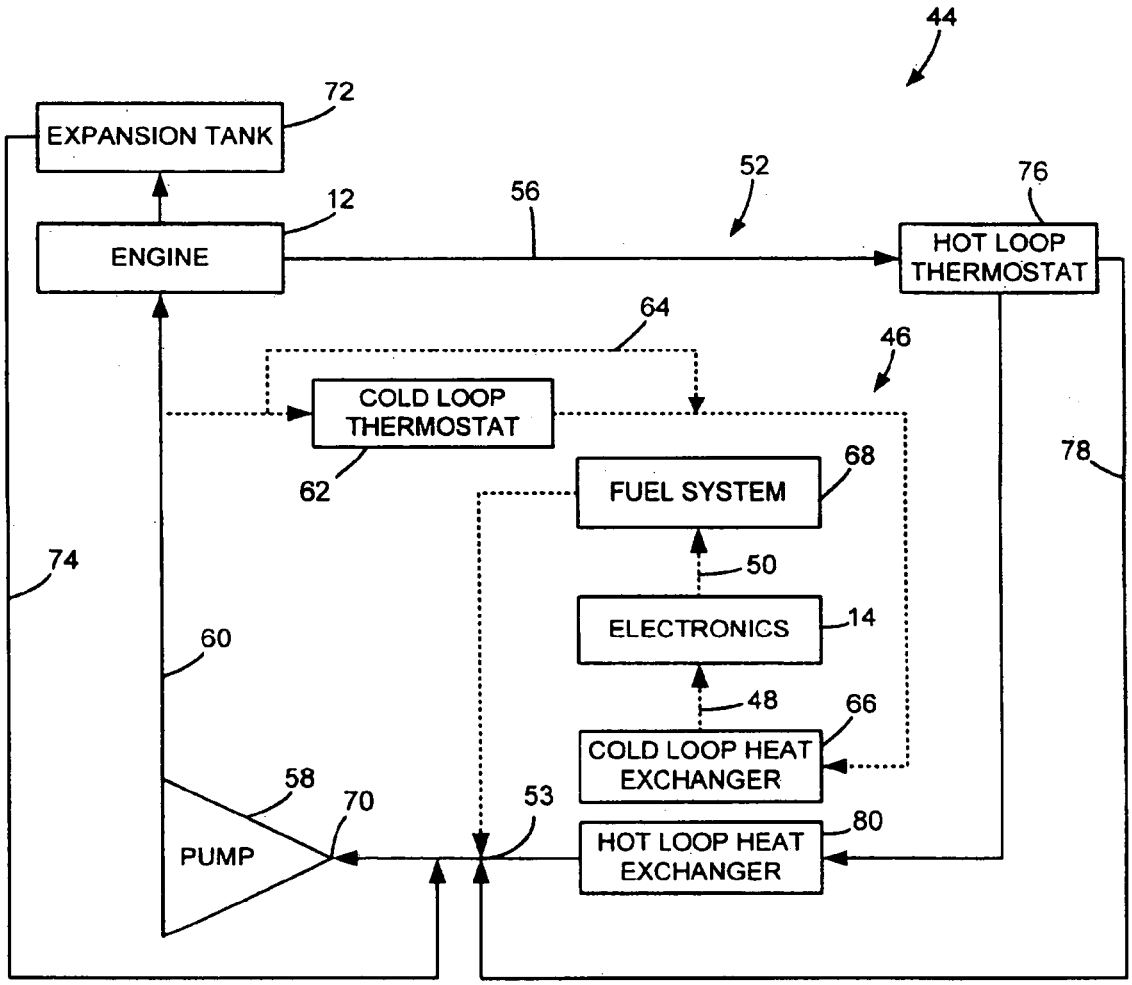
FIG. 2 is a block diagram of a cooling system for use with an engine such as that shown in FIG. 1.

FIG. 2 shows a schematic diagram of one embodiment of cooling system 44 shown in FIG. 1. A pump 58 recirculates the fluid of both first cooling loop 46, indicated partially by dashed lines, and second cooling loop 52, indicated by solid lines, from a common juncture 53 through a common leg 60. Common leg 60 discharges coolant to engine 12 and a cold loop thermostat 62. Cold loop thermostat 62 controls the temperature and amount of coolant circulated through first cooling loop 46. An optional bypass passage 64 allows coolant to circulate past cold loop thermostat 62 to provide a small amount of coolant through first cooling loop 46 and to provide some coolant in the event cold loop thermostat 62 fails. Coolant circulated past cold loop thermostat 62 flows to cold loop heat exchanger 66. It is understood that cold loop heat exchanger 66 can be constructed to exchange heat between a body of water that watercraft 10 is operated in or merely with an atmosphere much like an automotive radiator. An optional fan may be used to supply an adequate flow of air over the heat exchanger.

Once cooled at heat exchanger 66, first cooling loop 46 passes coolant to auxiliary equipment of engine 12. The auxiliary equipment may include system electronics 14, such as an ECU, and a fuel system 68, that may include a fuel vapor separator. These components are merely by way of example and are not intended to limit the potential for cooling other auxiliary systems of the particular type of equipment into which the engine may be installed. After circulating through the auxiliary equipment disposed along first cooling loop 46, coolant passing therethrough returns to an inlet side 70 of pump 58 and is recirculated. Unlike open loop cooling systems, once circulated through the coolant loop, the coolant is not dumped into the body of water, but is repeatedly recirculated through the system.

Second cooling loop 52 includes internal coolant passages in engine 12 that receive coolant from pump 58 via common leg 60. Second cooling loop 52 includes an expansion tank 72. Expansion tank 72 accommodates the expansion of the coolant circulated in cooling system 44 as the coolant achieves operating temperature. Rather than accommodating the expansion of the coolant with expansion tank 72, it could be dumped from the system as the temperature of the system increases, depending on the form of the coolant. For those systems that include expansion tank 72, a passage 74 is disposed between expansion tank 72 and inlet side 70 of pump 58. Such a construction allows fluid contained in the expansion tank to be recirculated by cooling system 44 and provides a reservoir to be drawn upon during cooling of the coolant in the system.

Coolant outlet 56 from engine 12 passes to a hot loop thermostat 76 which controls the temperature and volume of flow through second cooling loop 52. Thermostat 76 remains closed until engine 12 achieves a preferred operating temperature. When thermostat 76 is closed, coolant in second cooling loop 52 circulates through a small diameter bypass passage 78 and bypasses a hot loop heat exchanger 80 and returns to inlet side 70 of pump 58 to be recirculated. When engine 12 achieves a preferred operating temperature, thermostat 76 opens and allows coolant to pass through hot loop heat exchanger 80 and exchange thermal energy with the environment, thereby cooling the fluid of second cooling loop 52. Fluid passing through hot loop heat exchanger 80 is returned to inlet side 70 of pump 58 and essentially forms a closed loop. By forming two closed loops, cooling system 44 provides cooling to engine 12 along second cooling loop 52 at a temperature that is higher than an operating temperature of first cooling loop 46.

It is understood that the cold loop heat exchanger 66 and hot loop heat exchanger 80 could be of multiple constructions including two separate independent structures, or alternatively, the heat exchangers could be a one-piece structure. A one-piece heat exchanger can provide alternate cooling ratios by altering the flow speed or volume of the fluid through the respective heat exchanger, altering the cross-sectional area of the respective heat exchanger loops, or altering the number of loops in the heat exchanger for the first cooling loop and the second cooling loop. Additionally, even though the respective circuits of the first and second cooling loops are positioned in close proximity to one another, the two circuits are thermally isolated from one another at the heat exchangers, thereby maintaining a thermal separation between the first and the second cooling loops. Additionally, it is understood that the heat exchangers can be constructed to exchange heat with air or water. For marine applications, it is preferred to utilize the body of water for cooling the external surfaces of the heat exchanger.

Figure 3:
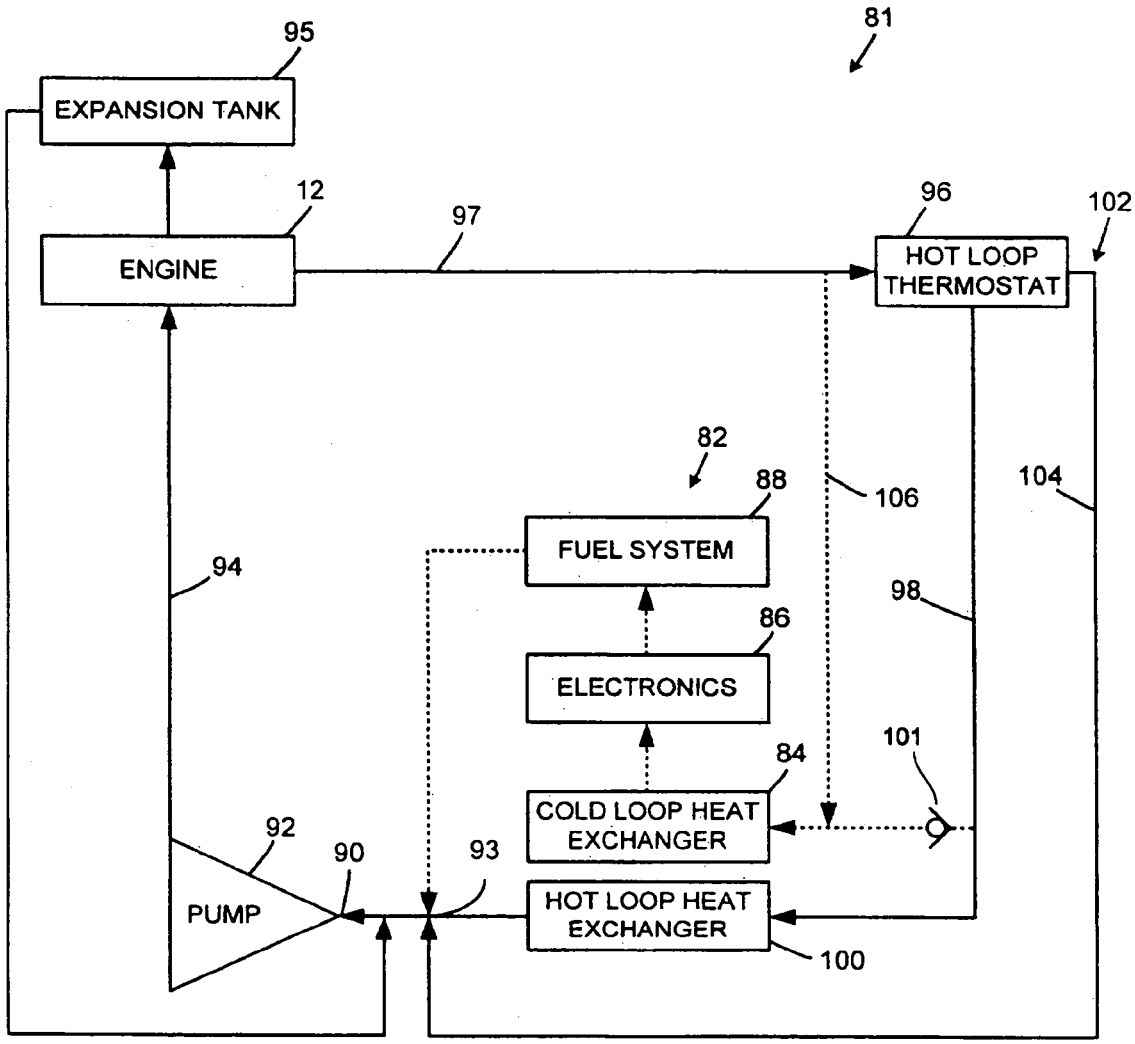
FIG. 3 is a block diagram similar to that of FIG. 2 of an alternate embodiment of the invention.

An alternate embodiment of a cooling system 81 in accordance with the present invention, is shown in FIG. 3. In this embodiment, a first cooling loop 82, partially indicated by the dashed lines, passes coolant through a cold loop heat exchanger 84 after circulation through engine 12, and then to auxiliary equipment 86, 88. Such auxiliary equipment includes an electronic component 86, such as the engine ECU, and an element of the fuel system 88, such as a fuel vapor separator. The flow through first cooling loop 82 then enters an inlet side 90 of a pump 92 at a common junction 93. Pump 92 has a common leg 94 that passes to engine 12. Similar to cooling system 44 shown in FIG. 2, cooling system 81 includes an expansion tank 95 disposed in the coolant path between engine 12 and inlet side 90 of pump 92. A hot loop thermostat 96 intersects a flow path 97 from engine 12. When engine 12 requires cooling, hot loop thermostat 96 opens and diverts coolant through passage 98. Passage 98 circulates fluid to both cold loop heat exchanger 84 and a hot loop heat exchanger 100. A check valve 101 is disposed between cold loop heat exchanger 84 and passage 98 and is oriented to compensate for a pressure differential that may exist between first cooling loop 82 and a second cooling loop 102, as indicated by solid lines. When hot loop thermostat 96 is in a closed position, indicating low engine operating temperature, a portion of the flow through flow path 97 follows bypass flow path 104 and circumvents hot loop heat exchanger 100, and then returns to inlet side 90 of pump 92 at common junction 93. Another flow path 106 bypasses hot loop thermostat 96 and allows cooling flow through first cooling loop 82 even when hot loop thermostat 96 is closed.

When compared to FIG. 2, it should be noted that coolant flow and temperature of first and second cooling loops 82, 102 of cooling system 81 are controlled by hot loop thermostat 96 and check valve 110, rather than a pair of thermostats 62, 76 as shown in FIG. 2. Such a construction allows the temperature of the first cooling loop 82 to be maintained at a temperature that is preferably lower than the preferred operating temperature of engine 12 which is the operating temperature of second cooling loop 102. Both cooling systems 44, FIGS. 2, and 81, FIG. 3, are constructed to allow mixing of coolant of the first and the second cooling loops at the inlet side of the pump. Such a construction minimizes the space occupied by the pump and simplifies the plumbing of the cooling system by having the two flows share portions of the fluid path while still providing a dual temperature system.

Figure 4:
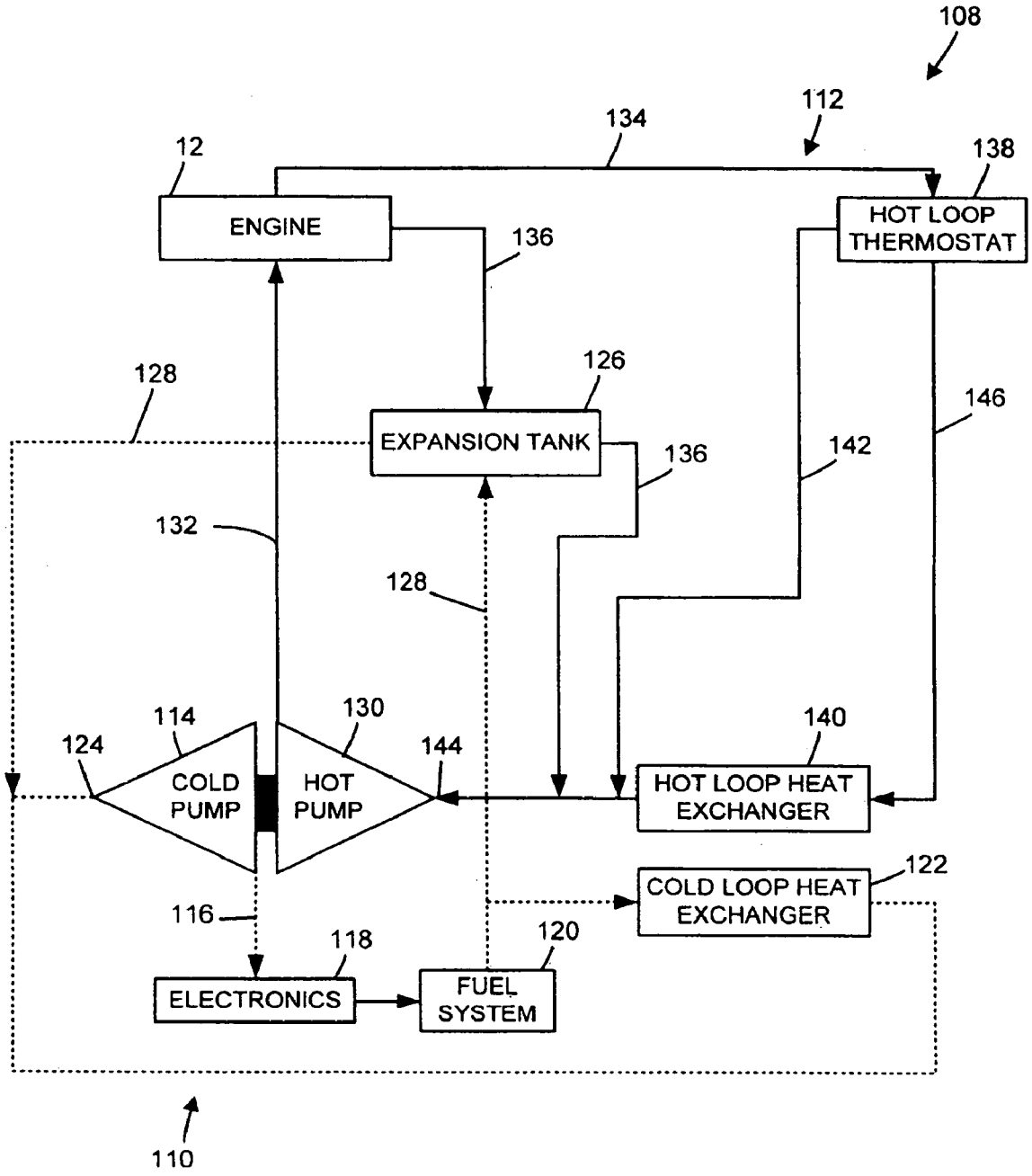
FIG. 4 is a block diagram of another alternate embodiment of a cooling system for use with an engine such as that shown in FIG. 1.

While cooling systems 44, FIGS. 2, and 81, FIG. 3, each have two closed loop cooling paths, they do share a common junction and leg. FIG. 4, on the other hand shows a cooling system 108 that, for the most part, has two completely isolated closed loop cooling paths. Cooling system 108 has a first cooling loop 110, indicated by dashed lines, and a second cooling loop 112, indicated by solid lines. First cooling loop 110 has a pump 114 which circulates coolant along first cooling loop 110. A discharge 116 from pump 114 provides coolant flow to an electronic component 118, such as an ECU, and a fuel system component 120, such as a vapor separator. First cooling loop 110 also includes a heat exchanger 122 disposed between fuel system component 120 and an inlet side 124 of pump 114. Optionally, an expansion tank 126 is disposed in an alternate passage 128 between fuel system component 120 and inlet side 124 of pump 114. Expansion tank 126 is constructed to accommodate the expansion of coolant circulated in the cooling loops as the operating temperature increases.

Unlike the cooling systems of FIG. 2 and FIG. 3, cooling system 108 of FIG. 4 includes another pump 130 constructed to recirculate the coolant of the second cooling loop 112. It is understood that pumps 114 and 130 can be completely independent, or as shown, be two dependent impellers on a common shaft. It is equally understood that, in order to maintain the efficiencies of the first and the second cooling loops, the pumps are preferably thermally insulated from one another.

A discharge 132 from pump 130 circulates coolant to engine 12. Coolant circulated in second cooling loop 112 passed through engine 12 diverges along a first passage 134 or a second passage 136. First passage 134 forms a fluid path from engine 12 to thermostat 138. When thermostat 138 is closed, engine 12 is operating below an optimal temperature and the cooling flow from engine 12 bypasses a heat exchanger 140 along a bypass passage 142. Passage 142 is in fluid communication with an inlet side 144 of pump 130 and allows second cooling loop 112 to increase in temperature until engine 12 achieves a desired operating temperature. When engine 12 reaches a preferred operating temperature, thermostat 138 opens and recirculates the cooling fluid through the heat exchanger 140 via passage 146. As such, when engine 12 is operating at or above a preferred operating temperature, second cooling loop 112 circulates fluid through heat exchanger 140 and cools the flow of engine coolant.

While reaching operating temperatures, the coolant in second cooling loop 112 will expand and require more volume when compared to the volume occupied by the coolant at below preferred temperatures. An expansion tank 126 is disposed in passage 136 between engine 12 and inlet side 144 of pump 130 to allow for expansion and contraction of the coolant.

Cooling system 108 for the most part maintains fluid and thermal isolation between first and second cooling loops 110, 112. Only internal component leakage such as between the respective impellers of pumps 124 and 130 and expansion tank 126 allows fluid communication between first cooling loop 110 and second cooling loop 112. It is understood that total fluid isolation between the first and second cooling loops could be provided with two separate pumps and two separate expansion tanks. Regardless, cooling system 108 provides a dual temperature closed loop cooling system with improved cool loop heat exchanger efficiency in that the cool loop heat exchanger does not have to compensate for the increased operating temperature associated with the hotter operating, engine side, cooling loop.

Figure 5:
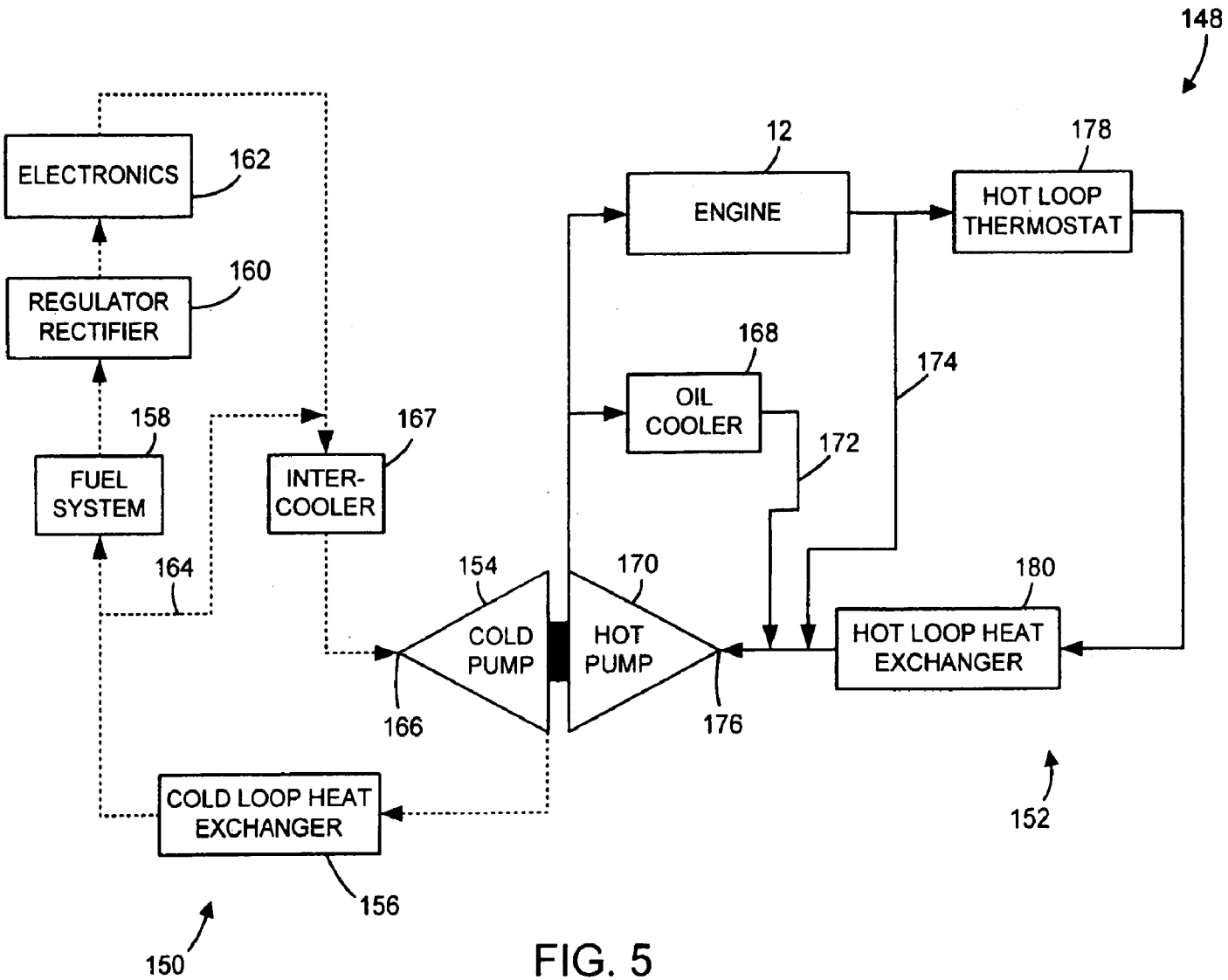
FIG. 5 is a block diagram similar to that of FIG. 4 of yet another alternate embodiment of the invention.

FIG. 5 shows another embodiment of a cooling system in accordance with the present invention. In this embodiment, cooling system 148 includes a first circuit 150 constructed to operate at a temperature lower than an operating temperature of a second circuit 152. First circuit 150 has a pump 154 which circulates the coolant flow of first circuit 150 to a heat exchanger 156 and from heat exchanger 156 to auxiliary components 158, 160, 162 of cooling system 148. A fuel system component 158, such as a vapor separator, a regulator/rectifier 160, and another electronic component 162, such as an ECU, are cooled by the flow through first circuit 150. An optional bypass 164 provides a fluid bypass around the auxiliary components of first circuit 150 when the components are at or below a preferred operating temperature. Prior to returning to an inlet side 166 of pump 152, coolant recirculating in first circuit 150 passes through an intercooler 167.

Second circuit 152 is substantially similar to second cooling loop 112, shown in FIG. 4, with the exception of an oil cooler 168. As shown in FIG. 5, a pump 170 is in fluid communication with engine 12 and oil cooler 168. Oil cooler 168 cools the lubrication oil circulated in a four-cycle engine. Both oil cooler 168 and engine 12 have a passage 172 and 174, respectively, in fluid communication with an inlet side 176 of pump 170. A thermostat 178 is also in fluid communication with engine 12 and controls the flow of coolant to a heat exchanger 180. When engine 12 is at or above a preferred operating temperature, thermostat 178 opens and allows the flow of coolant through heat exchanger 180 of second circuit 152 which cools the coolant circulated therethrough. When engine 12 is below a preferred operating temperature, thermostat 178 maintains a closed position and redirects coolant from engine 12 through passage 174 thereby bypassing heat exchanger 180. Such an orientation allows engine 12 to quickly achieve a preferred operating temperature by not cooling the coolant before it reaches a preferred operating temperature. Similar to cooling system 108, shown in FIG. 4, cooling system 148, shown in FIG. 5, maintains two thermally and fluidly separate cooling loops. Such a construction allows the engine to be maintained at a first temperature during operation and auxiliary components, such as the ECU and vapor separator, to be maintained at a lower temperature during operation of the engine.

It should be apparent that the cooling systems disclosed herein, while being applicable to both two-cycle and four-cycle internal combustion engines, are merely by way of example and in no way limit the claims. It is understood that many variations of orientation and component selection exist. That which is disclosed herein related to relative position of components and the selection of specific components is only by way of example and in no manner intended to limit the scope of the claims herein.

While the present invention is shown as being incorporated into an outboard motor, the present invention is equally applicable with many other applications, some of which include inboard motors, snowmobiles, personal watercraft, all-terrain vehicles (ATV's), motorcycles, mopeds, lawn and garden equipment, generators, etc.

The present invention has been described in terms of the preferred embodiment, and it is recognized that equivalents, alternatives, and modifications, aside from those expressly stated, are possible and within the scope of the appended claims.

What is claimed is:

1. An outboard motor adated to be operated in a body of water comprising:

a powerhead;

an engine housed in the powerhead, the engine having a vertical crankshaft;

a mid-section supporting the engine;

a lower unit coupled to the mid-section;

a propeller shaft housed in the lower unit and operatively coupled to the engine via the vertical crankshaft;

a cooling system for cooling the outboard motor;

the cooling system having a first cooling loop and a second cooling loop, each cooling loop providing a fluid path;

a first heat exchanger in thermal communication with the first one cooling loop a second heat exchanger in thermal communication with the second cooling loop; and the cooling system being fluidly separate from the body of water the first and the second heat exchangers being two separate circuits within a common heat exchanger.

2. An outboard motor comprising:

a powerhead;

an engine housed in the powerhead, the engine having a vertical crankshaft;

a fluid-cooled auxiliary component;

a mid-section supporting the engine a lower unit coupled to the mid-section;

a propeller shaft housed in the lower unit and operatively coupled to the engine via the vertical crankshaft;

a first closed cooling loop adapted to cool at least a portion of the engine;

a first heat exchanger in thermal communication with the first closed cooling loop;

a second closed cooling loop adapted to cool the auxiliary component; and a second heat exchanger in thermal communication with the second closed cooling loop;

the first and second heat exchangers being two separate circuits within a common heat exchanger.

3. An outboard motor adated to be operated in a body of water comprising:

a powerhead;

an engine housed in the powerhead, the engine having a vertical crankshaft;

a mid-section supporting the engine;

a lower unit coupled to the mid-section;

a propeller shaft housed in the lower unit and operatively coupled to the engine via the vertical crankshaft;

a cooling system for cooling the outboard motor;

the cooling system having a first cooling loop and a second cooling loop, each cooling loop providing a fluid path;

a first heat exchanger in thermal communication with the first cooling loop a second heat exchanger in thermal communication with the second cooling loop; and the cooling system being fluidly separate from the body of water, the first and second cooling loops operating at different temperatures.

4. The outboard engine of claim 3 wherein the first cooling loop branches off the second cooling loop upstream of the engine.

5. The outboard engine of claim 3 wherein the first and second cooling loops are fluidly separate from one another.

6. The outboard engine of claim 3 further comprising an auxiliary component in thermal communication with one of the first and second cooling loops, and wherein the auxiliary component is at least one of an electronic component, an electronic control unit, a fuel system component, and an intercooler.

7. The outboard engine of claim 3 further comprising:

a first thermostat located in fluid communication with the first cooling loop and constructed to regulate a flow therethrough; and a second thermostat located in fluid communication with the second cooling loop and constructed to regulate a flow therethrough.

8. The outboard engine of claim 3 further comprising a single pump for pumping coolant in the first and second cooling loops.

9. The outboard engine of claim 3 further comprising:

a first pump for pumping coolant in the first cooling loop; and a second pump for pumping coolant in the second cooling loop.

10. The outboard motor of claim 9 further comprising a single shaft actuating both the first and second pumps.

11. A method of cooling components of an outboard motor comprising the steps of:

providing an engine having a vertical crankshaft;

providing a fluid-cooled auxiliary component;

providing a cooling system having a first closed cooling loop and a second closed cooling loop;

cooling at least a portion of the engine with the first closed cooling loop;

cooling the auxiliary component with the second closed cooling loop;

providing a first heat exchanger;

thermally communicating the first heat exchanger with the first closed cooling loop;

providing a second heat exchanger;

thermally communicating the second heat exchanger with the second closed cooling loop;

providing a first thermostat;

fluidly communicating the first thermostat with the first closed cooling loop; and regulating the flow of coolant from the first closed cooling loop to the first heat exchanger using the first thermostat, providing a second thermostat;

fluidly communicating the second thermostat with the secondclosed cooling loop; and regulating the flow of coolant from the second closed cooling loop to the second heat exchanger using the first thermostat.

12. The method of claim 11 further comprising the steps of:

providing a pump; and pumping coolant in one or both of the first and second closed cooling loop using the pump.

13. An outboard motor comprising:

a powerhead;

an engine housed in the powerhead, the engine having a vertical crankshaft;

a fluid-cooled auxiliary component;

a mid-section supporting the engine;

a lower unit coupled to the mid-section;

a propeller shaft housed in the lower unit and operatively coupled to the engine via the vertical crankshaft;

a first closed cooling loop adapted to cool at least a portion of the engine;

a first heat exchanger in thermal communication with the first closed cooling loop;

a second closed cooling loop adapted to cool the auxiliary component; and a second heat exchanger in thermal communication with the second closed cooling loop, the first and second cooling loops operating at different temperatures.

14. The outboard engine of claim 13 wherein the auxiliary component is at least one of an electronic component, an electronic control unit, a fuel system component, and an intercooler.

15. The outboard engine of claim 13 further comprising:

a first thermostat located in fluid communication with the first closed cooling loop and constructed and arranged to regulate a flow therethrough; and a second thermostat located in fluid communication with the second closed cooling loop and constructed and arranged to regulate a flow therethrough.

16. The outboard engine of claim 13 further comprising:

a first pump for pumping coolant in the first closed cooling loop; and a second pump for pumping coolant in the second closed cooling loop.

* * * * *